United States Patent [19]

Oddicini

[11] 4,033,445

[45] July 5, 1977

[54] RIBBON FEED DEVICE FOR OFFICE MACHINES

[75] Inventor: Giuseppe Oddicini, Banchette (Turin), Italy

[73] Assignee: Ing. C. Olivetti & C., S.p.A., Ivrea (Turin), Italy

[22] Filed: Apr. 22, 1975

[21] Appl. No.: 570,528

[30] Foreign Application Priority Data

Apr. 24, 1974 Italy ..... 68293/74

[52] U.S. Cl. ..... 197/151; 197/169

[51] Int. Cl.[2] ..... B41J 33/14

[58] Field of Search ..... 197/151, 159, 169, 170

[56] References Cited

UNITED STATES PATENTS

| | | | |
|---|---|---|---|
| 2,919,784 | 1/1960 | Morris | 197/159 |
| 3,194,379 | 7/1965 | Szelnga | 197/151 |
| 3,346,090 | 10/1967 | Goff et al. | 197/151 |
| 3,349,887 | 10/1967 | Goff | 197/151 |
| 3,503,483 | 3/1970 | Santo | 197/151 |
| 3,882,989 | 5/1975 | Morelli | 197/151 |
| 3,889,795 | 6/1975 | Garberi et al. | 197/151 |

*Primary Examiner*—Edgar S. Burr
*Assistant Examiner*—William Pieprz
*Attorney, Agent, or Firm*—Schuyler, Birch, Swindler, McKie & Beckett

[57] ABSTRACT

A ribbon feed device for a ribbon in a cartridge, comprises means for supporting the cartridge with spools therein engaged on hubs of the device, guide means for guiding a length of ribbon looped out of the cartridge, and a single control member operable from a normal position to an operated position to shift the guide means transversely of the length of the ribbon to a position of greater accessibility for fitting the ribbon therein. The ribbon feed device is capable of accepting either an inked ribbon cartridge or a carbon coated cartridge and includes a pair of sensing levers urged by a spring adapted to sense the inked ribbon wound on the two spools respectively through apertures in the inked ribbon cartridge and to control means for effecting reversal of the movement of the inked ribbon. Moreover, the feed mechanism includes a feed roller and counter-roller for unidirectionally feeding the carbon coated ribbon. The control member withdraws the sensing levers from contact with the ribbon and the counter-roller from the feed roller. The inked ribbon cartridge includes a first aperture enabling the sensing levers to contact the inked ribbon wound on the two spools and a second aperture in which the feed roller and the counter-roller are freely rotatable, externally to the path of the inked ribbon in the cartridge. The carbon coated ribbon cartridge includes an aperture which engages the sensing levers and sets the mechanism to wind in the corresponding spool the ribbon fed thereto from the feed roller and counter-roller.

14 Claims, 7 Drawing Figures

RIBBON FEED DEVICE FOR OFFICE MACHINES

BACKGROUND OF THE INVENTION

The present invention relates to a ribbon feed device for typewriters and other office machines, wherein the ribbon is carried in a cartridge and is caused to advance longitudinally past the printing point by a feed mechanism.

In a known ribbon feed device, the ribbon is carried by a cartridge in which ribbon-carrying spools rotate. For facilitating the insertion of the ribbon in a printing unit of the kind having a single type-bearing head, a control lever is provided which raises a ribbon-guiding fork above the printing point, thus making it easy to mount the cartridge in the unit. A ribbon feed mechanism then provides for the longitudinal movement of the ribbon past the striking point.

In the case where the printing ribbon is of the inked type, the use of a movement reversing mechanism is required. In a mechanism of known type, the mounting of the cartridge does not require the actuation of any other part of the movement reversing mechanism. In fact, a pair of sensing elements are pivoted within the driving spindles of spools and, through apertures in the spindles and the spools, sense the presence of the wound ribbon from the inside. Each sensor then commands the reversal of the movement of the ribbon when the number of the turns of wound ribbon is no longer sufficient to keep the sensor concerned inoperative. The use of sensors of this type, however, makes the ribbon movement reversing mechanism itself rather complicated and costly to construct.

In the case where the printing ribbon is of the carbon coated type, the ribbon is fed through unidirectionally, once only, before the cartridge is changed. In one such device, the feed of the ribbon is carried out by a driving roller which, during the replacement of the cartridge, is held away from the ribbon by means of a control lever. It is therefore necessary to act on two separate members, one of which provides for the raising of the ribbon fork and the other for the control of the feed mechanism.

SUMMARY OF THE INVENTION

The object of the present invention is to provide a simpler device which is relatively cheap, can employ a simple and reliable feed mechanism and renders replacement of the ribbon cartridge easy.

According to the invetion there is provided a ribbon feed device for a ribbon in a cartridge, comprising means for supporting the cartridge with spools therein engaged on hubs of the device, guide means for guiding a length of ribbon looped out of the cartridge, and a single control member operable from a normal position to an operated position to shift the guide means transversely of the length of the ribbon to a position of greater accessibility for fitting the ribbon therein, and simultaneously to disenagage from the ribbon one or more ribbon-engaging elements of a mechanism which controls the feed of the ribbon.

BRIEF DESCRIPTION OF THE DRAWING

An embodiment of the invention is presented by way of example in the following description and the accompanying drawing, in which.

DESCRIPTION OF A PREFERRED EMBODIMENT

Figures 1, 7:
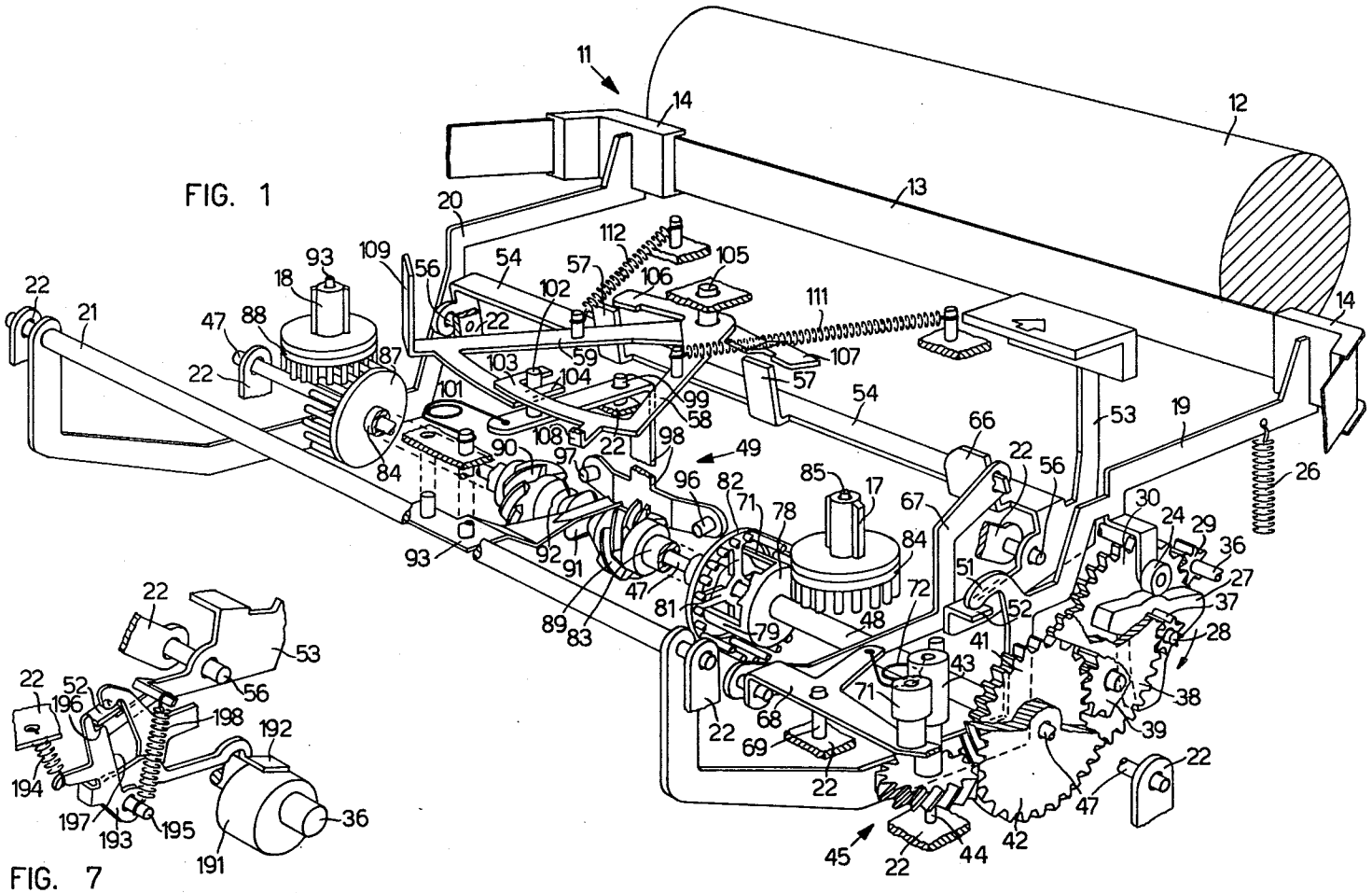
FIG. 1 is a partial perspecitve view of a ribbon feed device embodying the invention.
FIGS. 6 and 7 show variants of details of the ribbon feed device of FIG. 1.

Referring to FIG. 1, the ribbon feed device includes a ribbon-raising fork 11 which guides a printing ribbon 13 on a pair of guides 14 is front of the platen 12.

The printing ribbon 13 may be of the carbon coated type, in which the pigment is coated with an impermeable face of the ribbon and, with the impact of the character to be printed, is transferred totally to the paper, for which reason the ribbon is not-usable and a unidirectional advance of the ribbon is required. The ribbon 13, on the other hand, may be of the inked type. The ink them impregnates the ribbon, which is generally of fabric, and on the occurence of the impact, is partially transferred to the paper. The ribbon is re-usable, for which reason an advance of the ribbon in the two directions of movement thereof is required.

Figure 2:
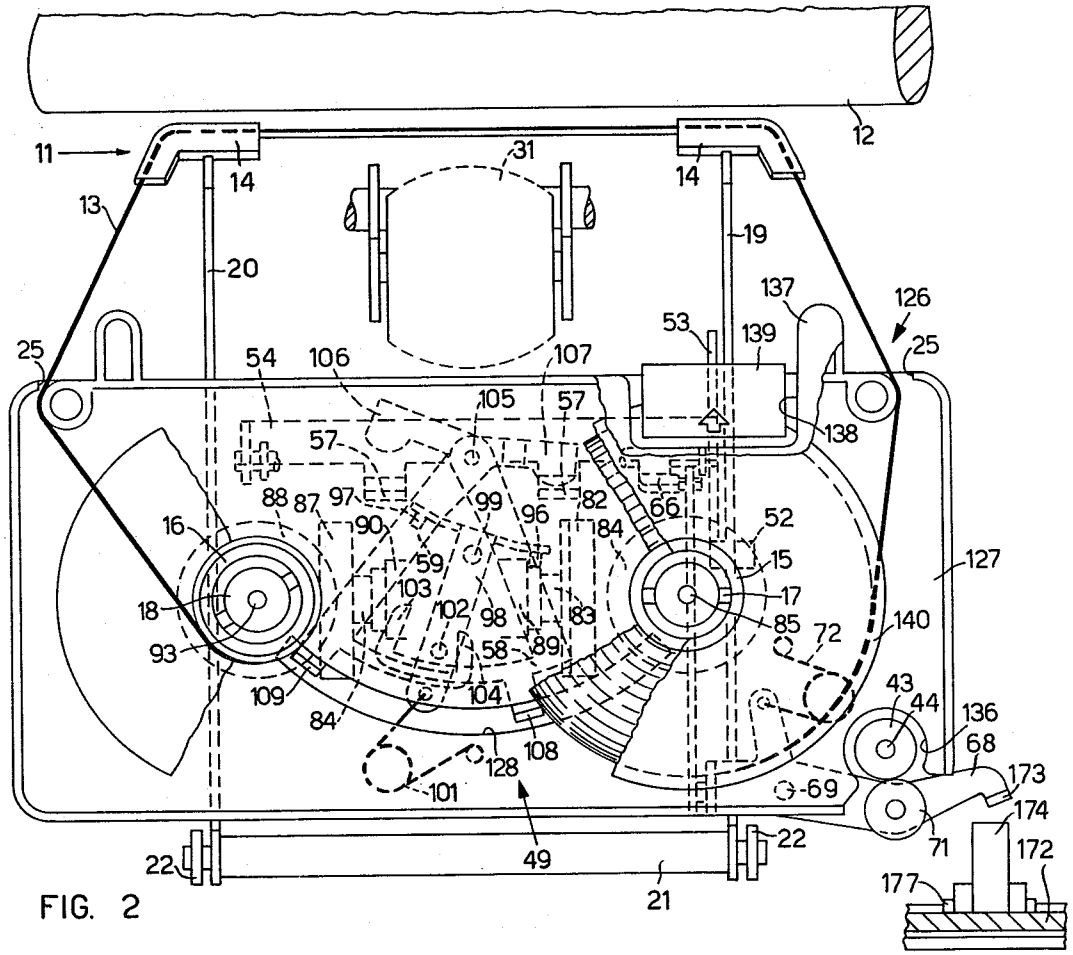
FIG. 2 is a partial plan view showing one particular way of using the device of FIG. 1.
Figure 3:
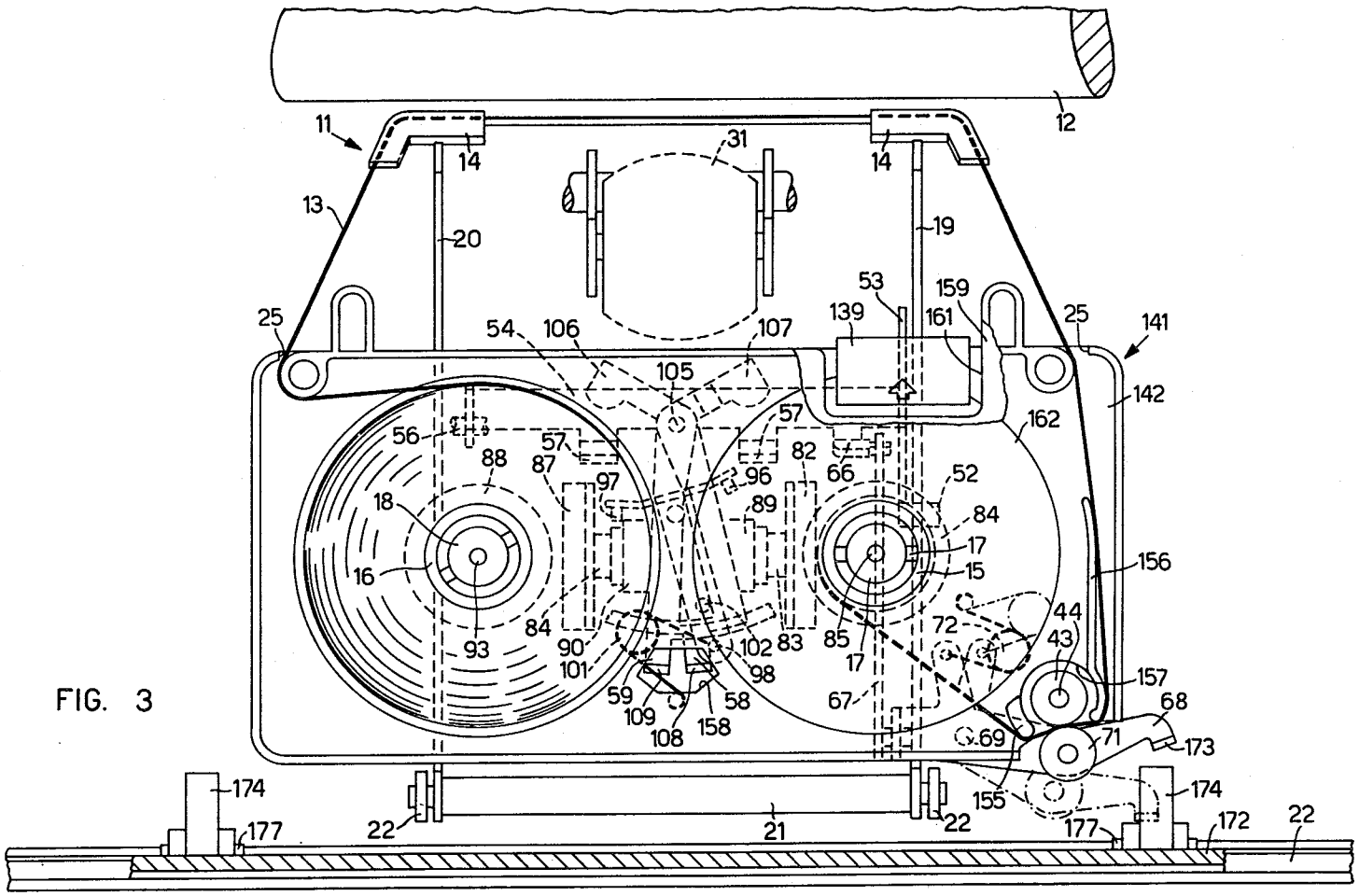
FIG. 3 is a partial plan view showing another use of the device according to FIG. 1.

As regards both one type and the other, the ribbon 13 is wound on two spools 15 and 16 (FIGS. 2 and 3) rotatable in corresponding cartridges 126 and 141 and adapted to engage corresponding hubs 17 and 18 (FIG. 1) on the machine. The guides 14 of the fork 11 provide for guiding the ribbon 13 emerging from a pair of rear slots 25 of the cartridges 126 and 141 between a type head 31 and the printing point of the platen 12 (FIGS. 2 and 3).

The fork 11 comprises two arms 19 and 20 rigidly connected by a shaft 21 (FIG. 1) parallel to the platen 1 and pivoted at its ends to the frame 22 of the machine. The arm 19 is equipped with a roller 24 which co-operates, under the action of a spring 26, with the profile of a cam 27 which can turn about a shaft 28 parallel to the platen 12. This cam 27 has three lobes having different lifts and, through a pair of reduction gears 29 and 30, is rotated clockwise through 120°, in correspondence with each printing cycle, by a driving shaft 36, in a manner known per se.

Via another train of spur reduction gears 37, 38, 39 and 41 and a pair of intermediate helical gears 42 with crossed axes, the cam 27 rotates a roller 43 about a pin 44 fixed vertically to the frame 22. The roller 44 forms part of a mechanism 45 for unidirectional advance of the ribbon 13, which is adapted to act on the printing ribbon 13 when this is of the carbon coated type, causing it to advance by constant amounts in each cycle. Moreover, through the same train of gears 37, 38, 39 and 41, the cam 27 rotates a sleeve 48 which can turn on a shaft 47 fixed in the frame 22 parallel to the platen 12. The sleeve 48, in turn, controls a mechanism 49 for bidirectional feed of the ribbon 13, which is adapted to act on the ribbon 13 when this is of the inked type, causing it to advance in the two directions in the manner which will be described hereinafter.

The arm 19 of the fork 11 is provided with a projection 51 with which a lug 52 of an upwardly extending lever 53, which is pivoted on the frame 22 by means of a crosspiece 54 parallel to the platen 12 and a pair of pins 56, is adapted to co-operate. The crosspiece 54 is adapted to co-operate by means of a pair of lugs 57 with two sensing or testing levers 58 and 59 of the mechanism 49 and is connected by means of another lug 66 and a connecting rod 67 to a lever 68 of the mechanism 45, this last-mentioned lever being pivoted in turn on a pin 69 fixed vertically to the frame 22.

A counter-roller 71 is rotatable on the lever 68 parallel to the roller 43. A hairpin spring 72 is adapted to keep the lever 68 turned either anticlockwise, with the lever 53 in the vertical position and the counter-roller 71 in contact with the roller 43, or clockwise, with the lever 53 swung back towards the platen 12 and the counter-roller 71 spaced away from the roller 43.

The bidirectional feed mechanism 49 includes a flange 78 keyed on the sleeve 48 and provided with four teeth 79 which co-operate with four corresponding spokes 81 of a pin wheel 82. The wheel 82 is fixed in turn on a sleeve 83 rotatable and slidable on the shaft 47 and which, in each of its axial positions, is rotated clockwise by the sleeve 48. When the sleeve 83 is shifted to the right, the pin wheel 82 meshes with a corresponding pin wheel 84 rotatable on a pin 85 fixed to the frame and frictionally connected to the hub 17 to rotate the hub clockwise. The sleeve 83 moreover carries another pin wheel 87 which, when the sleeve 83 is shifted to the left, meshes with a pin wheel 88 rotatable on a fixed pin 93 and frictionally connected to the hub 18 to rotate this hub anti-clockwise.

Finally, on the sleeve 83 there are fixed two helical gears 89 and 90, side by side with two conical zones 91 and 92 having a common base and apices towards the gears 89 and 90, forming two notches in either of which a spring positioning element 93, fixed to the frame 22, can engage. The gears 89 and 90 have their teeth inclined in opposite directions and are adapted to co-operate with two studs 96 and 97, respectively, fixed to a lever 98. This lever 98 can pivot on a pin 99 on the frame 22 of the machine and retains a hairpin spring 101 which tends to keep the lever 98 turned clockwise or anticlockwise. The lever 98 moreover carries a pin 102 which is adapted to co-operate with two projections 103 and 104, respectively, of th the levers 58 and 59. The levers 58 and 59 are pivoted in turn on a fixed pin 105 and are provided with two projections 106 and 107 adapted to co-operate with the lugs 57 of the crosspiece 54, and with two vertical lugs 108 and 109 adapted to cooperate with the turns of ribbon which are wound on the spools 15 and 16 (FIG. 2). Finally, the levers 58 and 59 (FIG. 1) are pulled by two like springs 111 and 112 which tend to cause the lever 58 to turn clockwise and the lever 59 to turn anticlockwise, respectively, holding the lever 98 in a substantially centred position, with the studs 96 and 97 disengaged from the helical gears 89 and 90.

Referring to FIG. 2, the printing ribbon 13 is in this case of the inked type and the corresponding cartridge 126 is shown mounted on the ribbon feed device in the operative position.

The cartridge 126 has a case 127 supporting the two spools 15 and 16. The inked ribbon 13 is wound on the two spools 15 and 16 in mutually opposite winding directions and runs from the spools 15 and 16 to the slots 25 along a path adjacent the side walls of the case 127. In the lower part of the case 127 there is formed an arcuate slot 128 having its center at the pin 105 and adapted to receive freely the vertical lugs 108 and 109 of the sensing levers 58 and 59, so that these can bear on the outer turns of the ribbon 13. Moreover, in the front right-hand corner of the case 127 there is formed an opening 136 adapted to receive the roller 43 and the counter-roller 71 freely without interference with the ribbon 13. A cover 137 for the cartridge 126 is provided with a rectangular opening 138 which allows access to a flange 140 of the spool 15 and is adapted to receive a handgrip 139 fixed to the lever 53 to close the opening 138 in the operative position of the arrangement.

Referring to FIG. 3, the printing ribbon 13 is in this case of the carbon coated type and the corresponding cartridge 141 is also shown mounted in the operative position.

The cartridge 141 has a case 142 supporting the two spools 15 and 16. The carbon coated ribbon 13 is wound clockwise on the spool 16, which is the feed spool here, and runs to the left-hand slot 25, passing adjacent the rear wall of the case 142. The ribbon 13 is moreover wound clockwise on the spool 15, which is the take-up spool here, and runs from the slot 25 on the right to the spool 15, guided by a corresponding rib 156, adjacent the right-hand side wall of the case 142, to the front right-hand corner of the case 142. In this corner there is formed an opening 157 adapted to receive the rollers 43 and 71 freely. Another rib 155 guides the ribbon 13 in turn from the front end of the rib 156 to the spool 15, across the opening 157 and along a path independent of the amount of ribbon wound on the spool 15, substantially as described in the Applicants'Italian Pat. No. 942,662, in such manner that the ribbon 13 passes between the rollers 43 and 71 to be moved along by them. Finally, the case 142 is provided in its lower part with another opening 158 which is adapted to receive the vertical lugs 108 and 109 of the sensing levers 58 and 59, to keep the lever 98 turned slightly clockwise through the medium of the corresponding pin 102. Lastly, a cover 159 provided with an opening 161 allows access to an upper flange 162 of the spool 15 and can be closed by the handgrip 139 of the lever 53 similarly to the cover 138 of the cartridge 126 (FIG. 2).

Figure 4:
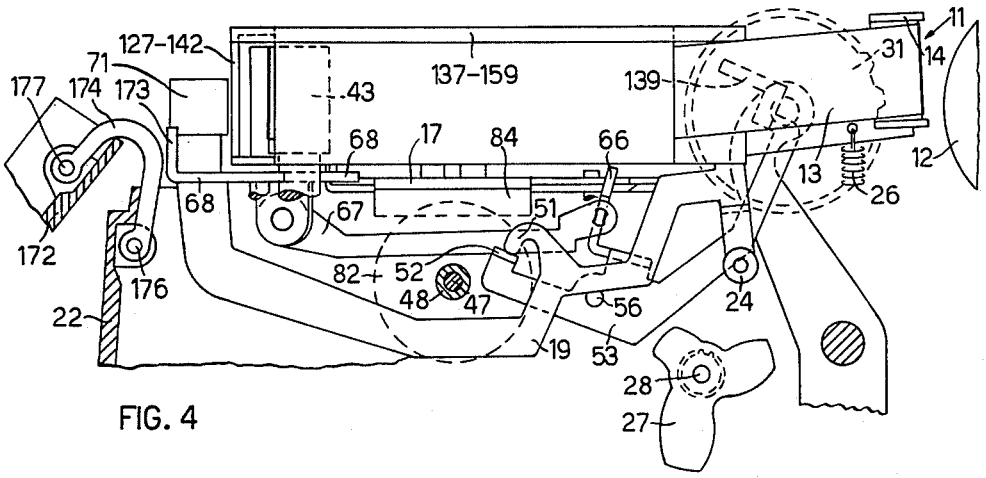
FIG. 4 is a partial side view of the device in a first working position.

Finally, the device is protected by a movable part 172 (FIG. 4) of the casing of the machine, which is connected to the frame 22 by means of a curved connecting rod 174 and a pair of hinges 176 and 177 on the frame 22 and the cover 172, respectively. This connecting rod 174 is adapted to co-operate in turn with a lug 173 of the lever 68 to bring the counter-roller 71 up to the roller 43.

Figure 5:
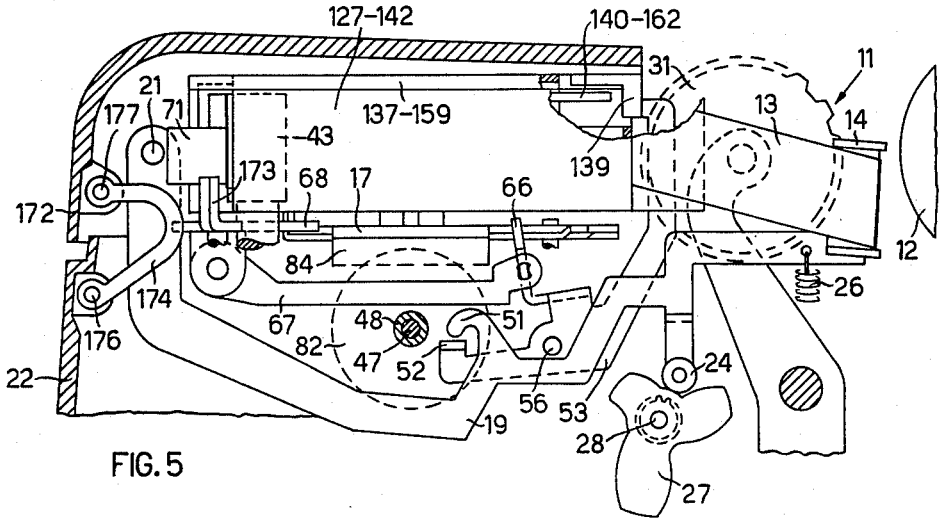
FIG. 5 is a partial side view of the device in a second working position.

In order to mount a cartridge 126 (FIG. 2) or 141 (FIG. 3), after swinging the movable part 172 (FIG. 5) of the casing forward, the handgrip 139 is pulled back, turning the lever 53 clockwise on the pins 56. The lug 52 of the lever 53 lifts the projection 51 of the arm 19 and the fork 11 swings upwardly on the pivots of the shaft 21, causing the roller 24 to leave the cam 27 (FIG. 4) and bringing the guides 14 above the head 31. At the same time, by means of the connecting rod 67, the lever 53 (FIG. 1) turns the lever 68 clockwise, first in opposition to the action of the hairpin spring 72 and then assisted by the same action, moving the counter-roller 71 away from the roller 43. Finally, by means of the lugs 57 of the crosspiece 54 and the projections 106 and 107, the lever 53 turns the lever 58 clockwise and the lever 59 anticlockwise, bringing the levers 58 and 59 together in this way until they are arrested against the pin 102 of the lever 98, which remains centered with both the studs 96 and 97 disengaged from the gears 89 and 90.

Either the cartridge 126 (FIG. 2) of inked ribbon 13 or the cartridge 141 (FIG. 3) of carbon coated ribbon 13 can now be mounted by engaging the respective spools 15 and 16 with the corresponding hubs 17 and 18 of the ribbon feed arrangement and the ribbon 13 in the guides 14, which are now readily accessible because of the high position of the fork 11.

In the case of mounting the inked ribbon cartridge 126 (FIG. 2), the lugs 108 and 109 of the levers 58 and 59 engage the arcuate slot 128, while the roller 43 and the counter-roller 71 engage the opening 136 without interfering with the ribbon 13.

Manual rotation of the flange 140 clockwise through the opening 138 places the ribbon 13 under tension between the guides 14. By bringing the lever 53 into the vertical position by means of the handgrip 139, the handgrip 139 closes the opening 138. While the counter-roller 71 bears on the roller 43 without having any effect on the ribbon 13, the roller 24 (FIG. 5) reengages the low profile of the cam 27. At the same time, the lugs 57 release the projections 106 and 107 (FIG. 1) of the levers 58 and 59, which, due to the action of the corresponding springs 111 and 112, turn anticlockwise and clockwise, respectively, until the corresponding vertical lugs 108 and 109 (FIG. 2) are arrested against the outer turns of the ribbon 13 wound on the respective spools 15 and 16.

In the case, shown in the drawing, in which the amount of inked ribbon 13 on the right-hand spool 15 is greater, the lever 58 is turned to a small extent, while the lever 59 is turned to a large extent. Under the action first of the projection 104 and then of the hairpin spring 101, the lever 98 is turned clockwise until the stud 96 is arrested either against the teeth or on the core of the gear 89, according to whether the sleeve 83 is shifted to the right or the left, respectively.

On starting a printing cycle, in the case where the sleeve 83 is to the right (FIG. 1), the stud 96 engages the space between two adjacent teeth of the gear 89. Because of the rotation of the sleeve 83 and because of the inclination of the teeth of the gear, the stud 96 moves the sleeve 83 along to the left. Initially this is opposed by the action of the positioning element 93 on the conical zone 91 but, when this resistance is overcome, the movement is assisted by the action of the positioning element 93 on the zone 92. The pin wheel 82 therefore leaves the wheel 84, while the pin wheel 87 meshes with the pin wheel 88, causing it to rotate anticlockwise and allowing the hub 18 (FIG. 2) to wind the ribbon 13 on to the corresponding spool 16 (FIG. 2). The stud 96 leaves the teeth of the gear 89 and bears on the corresponding core, in the inoperative position. The pin 99 pivoting the lever 98 is so positioned that the reaction of the teeth of the gear 89 on the stud 96 is directed substantially through the axis of the pin 99, so that the reaction has no substantial effect on the angular position of the lever 98 while the sleeve 83 is being shifted.

In the case of FIG. 2 in which, on the other hand, the sleeve 83 is already at the left, from the first printing cycle the stud 96 does not operate on the sleeve 83, which remains to the left, maintaining the meshing between the two pin wheels 87 and 88, as in the preceding case.

Continuing the printing of the characters, the amount of ribbon 13 wound on the spool 16 increases, while the wound on the spool 15 decreases. The lever 58 therefore turns anticlockwise and the corresponding projection 103 urges the pin 102 gradually to the right, in opposition to the action of the hairpin spring 101. The dead center of the spring 101 having been passed, the spring 101 causes the lever 98 to rotate anticlockwise with a snap action until the stud 97 is arrested on the teeth of the gear 90. The stud 97 engaging the space between two adjacent teeth, following the rotation of the sleeve 83, the stud shifts the sleeve 83 to the right. The wheel 87 is disengaged from the wheel 88, which is thus stopped. While the positioning element 93, engaging the conical zone 92 (FIG. 1), completes the shifting of the sleeve 83 to the right, the stud 97 disengages the gear 90 and the pin wheel 82 meshes with the pin wheel 84, thus reversing the direction of advance of the ribbon 13.

In a manner entirely similar to what has already been described, if an inked ribbon cartridge 126 (FIG. 2) in which the amount of ribbon 13 wound on the spool 16 is greater is fitted, on release of the lever 53 the lever 58 will be turned clockwise and the pin wheels 82 and 84 will be in mesh, either because on the fitting of the spools 15 and 16 the sleeve 83 is already on the right, or because the sleeve 83 will be shifted by the action of the stud 97 on the gear 90. In each case, the lever 98 is in the position in which it is turned anticlockwise and the ribbon 13 will unwind from the spool 16, being wound on the spool 15 until, when there is a minimum number of turns on the spool 16, the projection 104 of the lever 59, acting on the pin 102, will cause the spring 101 to overcome its dead center, causing the clockwise rotation of the lever 98. The stud 96 then engages the gear 89 to shift the sleeve 83 to the left, with the successive disengagement of the pin wheel 84 and the engagement of the pin wheel 88, thus reversing the direction of advance of the ribbon 13.

In the case of use of the cartridge 141 (FIG. 3) for ribbon 13 of the carbon coated type, with the handgrip 139 to the rear the fork 11 is in the raise position, the two levers 58 and 59 are in the centered position and the lever 68 is in the position indicated in chain-dotted lines. On inserting the corresponding spools 15 and 16 over the hubs 17 and 18, the ribbon 13, guided by the ribs 156 and 155, is disposed across the opening 157 between the roller 43 and the counter-roller 71, while the lugs 108 and 109 of the levers 58 and 59 engage the opening 158 of the case 142 with a clearance.

Manual rotation of the flange 162 clockwise places the ribbon 13 under tension along its path. By now bringing the lever 53 forward, as in fitting the cartridge 126 of FIG. 2, the handgrip 139 (FIG. 3) closes the opening 161 and the lug 52 causes the fork 11 to be lowered. By means of the connecting rod 67 and under the action of the hairpin spring 72, the lever 68 is turned anticlockwise into the position indicated in continuous lines until the carbon coated ribbon 13 is brought into engagement with the roller 43. Since, moreover, the lugs 57 have released the projection 106 and 107, the lugs 108 and 109 of the levers 58 and 59 are arrested by the walls of the opening 158, holding the lever 98 in the position in which it is turned slightly anticlockwise.

In the case in which the sleeve 83 is shifted to the right, the pin wheel 82 is in engagement with the corresponding wheel 84, while the stud 97 is disengaged from the teeth of the gear 90. At each printing cycle, the rotation of the gear 30 (FIG. 1) produces a clockwise rotation both of the sleeve 83 and of the roller 43. Backed by the counter-roller 71, at each printing cycle the ribbon 13 (FIG. 3) is therefore shifted to the right by constant increments past the printing point and these increments are collected by the spool 15. The frictional connection between the hub 17 and the pin wheel 84 enables the latter to rotate by constant angular increments irrespective of the number of turns wound on the spool 15.

In the case in which the sleeve 83 is shifted to the left, on the other hand, the pin wheel 87 is in engagement with the corresponding wheel 88 and the stud 97 is in engagement with the teeth of the gear 90. Also in this case, at each printing cycle the roller 43 moves the ribbon 13 to the right by constant increments. In the first printing cycles, the wheel 88 is rotated counterclockwise and gives up a small amount of ribbon, while the wheel 84 is stationary, the stud 97 engages on the other hand the spaces of the gear 90 and shifts the sleeve 83 to the right in the manner already described, restoring the conditions described in the preceding paragraph.

Both in the case of carbon coated ribbon and in the case of inked ribbon, at each printing cycle the lobes of the cam 27 (FIG. 5) raise the ribbon 13 itself with respect to the printing point the different heights, utilizing the entire width of the ribbon in this way.

In the event of the operator omitting, after fitting a cartridge 126 (FIG. 2) or a cartridge 141 (FIG. 3), to bring the handgrip 139 forward, but closing the movable part 172 of the casing, as is necessary to gain access to the keyboard (not shown in the drawings), he pushes the lug 173 of the lever 68 by means of the curved connecting rod 174, thus automatically ensuring the bringing-up of the counter-roller 71 to the roller 43 and the simultaneous shifting forward of the lever 53, bringing the arrangement into the operative state already described.

Figure 6:
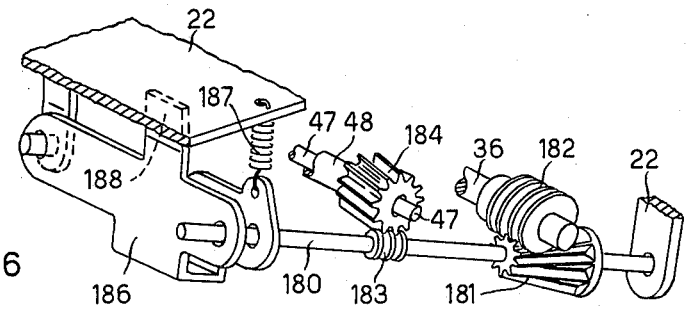

It is understood that many modifications are possible without departing from the scope of the invention as claimed. For example, in one variant, while the roller 43 of the mechanism is connected to the shaft 36 (FIG. 1) through the medium of the described train of gears, a torque limiter is provided in the mechanism 49. In this way, the load on the sleeve 48 is limited in the event of jamming in the mechanism 49, which could cause serious damage to the various kinematic components by reason of the high tensile strength of the inked ribbon, which is usually made of fabric. To this end, the sleeve 48 is connected to the shaft 36 (FIG. 6) by means of an intermediate shaft 180 on which there are fixed a worm wheel 181, in mesh with a worm 182 fixed on the shaft 36, and a worm 183 in mesh with a worm wheel 184 fixed to the sleeve 48. The shaft 180 is rotatable in the frame 22 at one end adjacent the worm wheel 181 and is rotatable at the other end, adjacent the worm 183, in a bail 186 pivoted on the frame 22 and arrested against the frame 22 by means of a spring 187 and a projection 188.

In the event of the load on the sleeve 48 exceeding the predetermined value during the movement of the inked ribbon 13, the worm 183 disengages itself from the worm wheel 184 in opposition to the action of the spring 187, thus interrupting the rotation of the sleeve 48. On the cessation of the cause of the trouble, the spring 187 will cause the bail 186 to pivot, re-engaging the worm 183 with the worm wheel 184 for reestablishment of the normal conditions.

According to another variant, the actuation of the lever 53 after the fitting of the cartridge can take place on the first printing cycle, without any control on the part of the operator. To this end, on the shaft 36 (FIG. 7) there is fixed a cam 191 which is adapted to co-operate with a lug 192 of a cranked lever 193 pivoted on a fixed pin 195 under the action of a spring 194 on the lever 193. One arm of the lever 193 is provided in turn with a shoulder 196 adapted to retain the lug 52 of the lever 53, and with a rear edge 197 which normally arrests the front edge of the lug 52.

On bringing the lever 53 backward for removal of the cartridge, the lug 52 is brought above the shoulder 196. The spring 194 causes the lever 193 to turn clockwise and arranges the shoulder 196 below the lug 52, while the spring 198 locks the lug 52 on the shoulder 196. Manual return of the lever 53 to the operative position is therefore prevented. The first printing cycle having been started, the cam 191 causes the lever 193 to turn anticlockwise, releasing the lug 52 and allowing the spring 198 to bring the lever 53 back into the operative position.

I claim:

1. A ribbon feed device for a printing ribbon for use in a typewriter or the like wherein the typewriter includes a platen having a printing area thereon and a type head mounted opposite the printing area of the platen and wherein the printing ribbon is enclosed in a cartridge provided with two openings from which a run of said printing ribbon is looped out of the cartridge, said feed device comprising: means receptive of the ribbon cartridge for supporting same; an actuable feed mechanism for feeding said ribbon from one opening to the other of said two openings including a feed roller rotatably mounted in the machine; means capable of alternatively accepting an inked ribbon cartridge wherein the printing ribbon is of the inked type wound in coils about two spools, or a carbon coated ribbon cartridge in which the printing ribbon is of the carbon coated type; means defining an aperture in a predetermined portion of the cartridge for receiving the feed rollers; means for guiding a carbon coated ribbon toward said aperture; wherein the device further comprises a pair of guide members each positioned on one side of said head for guiding said looped run of the printing ribbon between the platen and the printing head;

means movable mounting the guide members for angular displacement in a plane perpendicular to the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism including a counter-roller and a support rotatably mounting said counter-roller, means mounting said support in the machine for movement from a released position, in which said conter-roller is away from a carbon ribbon, to an engaged position in which said counter-roller grips a carbon coated ribbon against said feed roller for unidirectly feeding the carbon coated ribbon from the one to the other of said two openings;

means for guiding an inked ribbon in the cartridge so as not to pass between the roller and the counter-roller;

a single control member manually operable from a rest position to an operative position for shifting said pair of guide members from said high position and to jointsly disengage said control means from said printing ribbon; jointly and wherein said feed mechanism further comprises two hubs engageable with said spools, reversing means for selectively driving either hub in the sense drawing the ribbon on to the corresponding spool with the reversal means causing the two hubs to be alternatively so driven, a motive shaft, a single driving member for driving both the feed roller and the reversing means, and coupling means connecting said motive shaft with said driving member for limiting the resistance torque of said driving member to a predetermined maximum value on said motive shaft, said coupling means comprising a pair of gear elements mounted on said motive shaft and on said driving member, respectively, and inclining a worm wheel and a worm gear support means movably mounting one of said pair of gear elements and spring means operative on said support for resiliently holding said worm wheel and said worm in engagement in such a manner as to transmit the torque of said motive shaft to said driving member and the other of said pair of gear elements and when the resistance torque of said driving member is more than said predetermined valve causing the support to be moved against the action of said spring means thereby causing said worm wheel to disengage from said worm gear.

2. A carbon coated ribbon cartridge removably mountable in a typewriter of the type which utilizes both ink and carbon coated ribbon cartridges wherein the ribbon is wound around two spools and having a platen with a printing area defined thereon, a type head mounted in front of the printing area and a feed device for feeding a ribbon between the type head and the printing area including two rotatable hubs, each one engageable with one associated spool of said two spools, sensing means for sensing that a predetermined minimum quantity of wound ribbon is available for use including two pivotally mounted levers associated with said hubs and each having a projection at the end portion thereof for cooperating with the ribbon wound on the one associated spool, motive means responsive to the position of said levers for driving one or the other of said spools for bidirectionally feeding the ribbon in front of said printing area roller means including a pressure roller and a motive roller engageable with said carbon ribbon for unidirectionally feeding the ribbon from the printing area to one of the hubs, said cartridge comprising:

a case including upper and lower substantially parallel walls and sidewalls;

a take-up spool of said two spools rotatably mounted in said case and engageable with said one hub and around which a carbon coated ribbon is to be taken-up during use;

a feed spool of said two spools rotatably mounted in said case and engageable with the other hub and around which a carbon coated ribbon is wound for feeding by said feed device during use;

means defining two slots in one sidewall of said case which faces the printing area when the cartridge is mounted, one of said slots providing an exit from the case and the other slot providing entry into the case through which a run of ribbon is looped;

means for guiding the ribbon from said other slot to the outside of said take-up spool along a predetermined path;

means defining an access aperture in a portion of said case opposite from said one sidewall configured to receive said pressure roller and said motive roller to permit engagement of the ribbon by said roller means between said guide means and the take-up spool when the cartridge is mounted along said path;

means defining another aperture in the lower wall of said case configured to receive the two projections of the two levers therein during use of the cartridge; and control means cooperative with one of said levers, when the cartridge is mounted, and avoiding the projection of said one lever to cooperate with the ribbon wound on said corresponding spool for causing said motive means to rotate said one hub, thereby winding on said take-up spool the ribbon fed thereto by said roller means.

3. A cartridge according to claim 2, wherein said control means comprises an edge of said other aperture cooperative with one of said projections.

4. A cartridge according to claim 2, wherein said levers are urged by spring means towards said hubs, wherein said typewriter further comprises a moveable handgrip, movable between a first position, in which it holds said levers away from said spools against the action of said spring means, and a second position, in which it releases said levers for the movement of said projection towards said hubs, and wherein the other aperture of said case is configured to receive the two projections of said levers in the first position of said handgrip and to limit the movement said of one of lever.

5. A cartridge according to claim 4 wherein said take-up spool further comprises a flange thereon and wherein said case further comprises means defining an opening therein configured to receive said handgrip in the second position thereof.

6. An inked ribbon cartridge removably mountable in a typewriter of the type which utilizes both ink and carbon coated ribbon cartridges wherein the ribbon is wound around two spools and having a platen with a printing area defined thereon, a type head mounted in front of the printing area, wherein said ribbon has a section larger than said printing area, means for lifting different portions of the section of said ribbon in front of said printing area and a feed device for feeding a ribbon between the type head and the printing area including two rotatable hubs, sensing means for sensing that a predetermined minimum quantity of wound ribbon is available for use including two pivotally mounted levers each having a projection at the end portion thereof for cooperating with the ribbon wound around the spools, said projection being substantially parallel to said hubs, a control member rotating said levers, for the disengaging thereof from said spools, toward a centered position, reversing means coactive with said sensing means for reversing the driving of said hub in response to the predetermined minimum quantity of wound ribbon being available on the undriven hub, and means cooperative with said reversing means for driving one of the hubs at a time in a predetermined sense of rotation and roller means for unidirectionlly feeding the ribbon from the printing area to one of the hubs, said cartridge comprising:

a substantially closed case including upper and lower substantially parallel walls and sidewalls;

a first spool rotatably mounted in said case and engageable with one hub and around which an inked ribbon is wound or unwound during use;

a second spool rotatably mounted in said case and engageable with the other hub and around which and inked coated ribbon is wound or unwound during use;

means defining two slots in one sidewall of said case which faces the printing area when the cartridge is mounted, each of said slots alternatively providing an exit from the case and entry into the case through which a run of ribbon is looped;

means defining an arcuate slot in the lower wall of said case configured to freely receive the two projections of the two levers therein to permit said projections to contact with the ribbon wound on the spools for different quantities of ribbon wound and to be disengaged therefrom, said arcuate slot maintaining the substantially closed structure of the case; and means defining an access opening in a portion of said case opposite from said one sidewall configured to receive said roller means, said inked ribbon being located in the interior of said case to be external of said roller means so as not to be in engagement therewith.

7. A cartridge according to claim 6, wherein the center point of the circle of which the arcuate slot is a section coincides with the pivot axis of the levers.

8. A ribbon feed device for a printing ribbon of the inked or carbon type for use in a typewriter or the like wherein the typewriter includes a platen a printing area thereon and a type head mounted opposite the printing area of the platen and wherein the printing ribbon is enclosed in a cartridge provided with two openings from which a run of said printing ribbon is looped out of the cartridge wherein the cartridge includes a container, a feed spool on which the ribbon is wound and a take-up spool on which the ribbon is to be wound after passing in front of the printing area of the platen and access apertures therein allowing external access to the spools, said feed device comprising:

means alternatively receptive of a carbon or an inked ribbon cartridge for supporting same;

an actuatable feed mechanism for feeding said ribbon from one opening to the other of said two openings;

a pair of guide members each positioned on one side of said head for guiding said looped run of the printing ribbon between the platen and the printing head;

means movably mounting the guide member for angular displacement in a plane perpendicular to the the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism wherein said control means includes a pair of sensing levers passing through said access apertures of the container to contact an inked ribbon wound on the two spools, respectively sensing that there is greater than a predetermined minimum quantity of ribbon on each spool;

a single control member manually operable from a rest position to an operative position for shifting said pair of guide members from said low position to said high position and means connecting said control member with said control means for disengaging said control means from said printing ribbon, jointly with the shifting of the guide members into said high position and wherein the control member, when in the operative position, withdraws the sensing levers from contact with the ribbon coils; and wherein said feed mechanism includes two hubs engageable with said spools, reversing means cooperative with said sensing levers for effecting the driving of one or the other of said hubs to reverse the movement of an inked ribbon in the cartridge in response to the predetermined minimum quantity of ribbon coils wound in one of said spools, wherein a first hub of said two hubs is engageable with said take-up spool, a feed roller, a counter-roller engaging a carbon coated ribbon against said feed roller and driving means operable on said feed roller for unidirectionally feeding a carbon coated ribbon through said openings from said feed spool to said take-up spool, said carbon coated ribbon cartridge further including means engaging at least one lever of the sensing levers to position said at least one lever to cause said reversing means to drive the first hub to wind, on the corresponding take-up spool, the ribbon fed thereto from the feed spool by the feed roller.

9. A ribbon feed device for a carbon coated printing ribbon for use in a typewriter or the like wherein the typewriter includes a platen having a printing area thereon and a type head mounted opposite the printing area of the platen and wherein the printing ribbon is enclosed in a cartridge including means defining an aperture in a predetermined portion thereof, means guiding the carbon coated ribbon toward said aperture and two openings from which a run of said printing ribbon is looped out of the cartridge, said feed device comprising;

means receptive of the ribbon cartridge for supporting same;

an actuatable feed mechanism for feeding said ribbon from one opening to the other of said two openings including a feed roller rotatably mounted in the machine and insertable in said aperture;

a pair of guide members each positioned on one side of said head for guiding said looped run of the printing ribbon between the platen and the printing head;

means movably mounting the guide members for angular displacement in a plane perpendicular to the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism including a counter-roller and a support rotatably mounting said counter-roller and means mounting said support in the machine for movement from a released position, in which said counter-roller is away from said ribbon, to an engaged position in which said counter-roller grips said carbon coated ribbon against said roller for unidirectionally feeding said carbon coated ribbon from the one to the other of said two openings;

a single control member manually operable from a rest position to an operative position for shifting said pair of guide members from said low position to said high position; and means connecting said control member with said control means for disengaging said control means from said printing ribbon, jointly with the shifting of the guide members into said high position and wherein said control member is connected with said counter-roller support for moving said support from said engaged position to said released position when said control member is moved from said rest position to said operative position.

10. A ribbon feed device according to claim 9, wherein the device comprises means capable of alternatively accepting an inked ribbon cartridge wherein the printing ribbon is of the inked type, said inked ribbon cartridge including a container and two spools rotatable in the container and about which said inked ribbon is wound in coils, the container also comprising said aperture and means guiding the inked ribbon in the cartridge so as not to pass between the roller and the counter-roller and wherein said feed mechanism further includes two hubs engageable with said spools and reversing means for selectively driving either hub in the sense drawing the ribbon on to the corresponding spool with the reversal means causing the two hubs to be alternately so driven.

11. A ribbon feed device for a printing ribbon for use in a typewriter or the like wherein the typewriter includes a platen having a printing area thereon and a type head mounted opposite the printing area of the platen and wherein the printing ribbon is enclosed in a cartridge provided with two openings from which a run of said printing ribbon is looped out of the cartridge, said feed device comprising:

means receptive of the ribbon cartridge for supporting same;

an actuatable feed mechanism for feeding said ribbon from one opening to the other of said two openings;

a pair of guide members each positioned on one side of said head for guiding said run of the printing ribbon between the platen and the printing head;

means movably mounting the guide members for angular displacement in a plane perpendicular to the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism;

a single control member manually operable from a rest position to an operative position for shifting said pair of guide members from said low position to said high position;

means connecting said control member with said control means for disengaging said control means from said printing ribbon, jointly with the shifting of the guide members into said high position; and a casing movable from a closed position in which said casing covers said cartridge and the feed mechanism for the protection thereof to an open position in which said casing allows the changing of the cartridge, said casing including coupling means coupled to said control member to cause said control member to return from the operative position to the rest position when the casing is moved from said open position to the rest position when the casing is moved from said open position to said closed position with said control member in said operative position.

12. A ribbon feed device for a printing ribbon for use in a typewriter or the like wherein the typewriter includes a platen having a printing area thereon, a type head mounted opposite the printing area of the platen and a print mechanism actuatable to cause the printing head to strike the platen for the printing of a corresponding character in a printing cycle and wherein the printing ribbon is enclosed in a cartridge provided with two openings from which a run of said printing ribbon is looped out of the cartridge, said feed device comprising:

means receptive of the ribbon cartridge for supporting time;

an actuatable feed mechanism for feeding said ribbon from one opening to the other of said two openings;

a pair of guide members each positioned on one side of said head for guiding said looped run of the printing ribbon between the platen and the printing head;

means movably mounting the guide members for angular displacement in a plane perpendicular to the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism;

a single control member manually operable from a rest position to an operative position for shifting said pair of guide members from said low position to said high position;

means connecting said control member with said control means for disengaging said control means from said printing ribbon, jointly with the shifting of the guide members into said high position; and means operable by said printing mechanism to automatically return the control member from the operative position to the rest position when the printing cycle begins with the control member in the operative position.

13. A ribbon feed device for a printing ribbon for use in a typewriter or the like wherein the typewriter includes a platen having a printing area thereon and a type head mounted opposite the printing area of the platen and wherein the printing ribbon is enclosed in a cartridge provided with two openings from which a run of said printing ribbon is looped out of the cartridge, said feed device comprising;

means receptive of the ribbon cartridge for supporting same;

an actuatable feed mechanism for feeding said ribbon from one opening to the other of said two openings;

a pair of guide members each positioned on one side of said head for guiding said looped run of the printing ribbon between the platen and the printing head;

means movably mounting the guide members for angular displacement in a plane perpendicular to the plane of the supported ribbon cartridge;

lift means for lifting the pair of guide members from a low position wherein the printing ribbon is located below the printing area of the platen to a high position wherein the ribbon is located between the printing head and the platen in a position facilitating the insertion thereof in said pair of guide members;

control means engageable with the inserted printing ribbon for actuating said feed mechanism;

a single control member manually operable from a rest position to an operative position for shifting said pair of guide members from said low position to said high position;

means connecting said control member with said control means for disengaging said control means from said printing ribbon, jointly with the shifting of the guide members into said high position, and a bistable spring operative on said control member for holding the same arrested in said rest and in said operative positions, said bistable spring having an unstable position corresponding to a position of said control member intermediate between said rest and said operative position, in which said spring pulls the control member towards said rest or said operative position, so that the operation of said control member can be effected from said rest position or from said inoperative position just beyond said unstable position.

14. A ribbon feed device for an inked printing ribbon for use in a typewriter or the like wherein the typewriter includes a platen having a printing area thereon and a type head mounted opposite the printing area of the platen and wherein the printing ribbon is enclosed in a cartridge including a container and two spools rotatable in the container and about which said inked ribbon is wound in coils, access apertures therein allowing the external access to the spools and two openings from which a run of said printing ribbon is looped out of the cartridge, said feed device comprising;

means receptive of the ribbon cartridge for supporting same;

an actuatable feed mechanism for feeding said ribbon from one opening to the other of said two openings;

a pair of guide members each positioned on one side of said head for guiding head looped run of the printing ribbon between the platen and the printing head;

means movably mounting the guide members for angular displacement in a plane perpendicular to the plane of the supported ribbon cartridge;

lift means for lifting the pair of guide members from a low position wherein the printing ribbon is located below the printing area of a platen to a high position wherein the ribbon is located between the printing head and the platen in a position facilitating the insertion thereof in said pair of guide members;

control means engageable with the inserted printing ribbon for actuating said feed mechanism comprising a pair of sensing levers pivoted on a common pivot and each having a projection passing through the access apertures and cooperative with the coils of ribbon wound on said spools when the cartridge is mounted for pivoting said levers about said pivot to respectively sense that there is greater than a predetermined minimum quantity of ribbon on each spool, wherein said container includes upper and lower substantially parallel walls and side walls, and wherein said access aperture comprises an arcuate slot in the lower wall of said container to freely receive the projection of said levers during the pivoting movement of said projections; and a single control member manually operable from a rest position to an operative position for shifting said pair of guide members from said low position to said high position;

means connecting said control member with said control means for disengaging said control means from said printing ribbon, jointly with the shifting of the guide members into said high position; and wherein said feed mechanism includes two hubs engageable with said spools and reversing means cooperative with said sensing levers for effecting the driving of one or the other of said hubs to reverse the movement of the inked ribbon in the cartridge in response to the predetermined minimum quantity of ribbon coils wound in one of said spools and wherein the control member, when in the operative position, withdraws the sensing levers from contact with the ribbon coils.

* * * * *